US010094029B2

(12) United States Patent
Asada et al.

(10) Patent No.: US 10,094,029 B2
(45) Date of Patent: Oct. 9, 2018

(54) CHLORINE DIOXIDE PRODUCTION DEVICE AND CHLORINE DIOXIDE PRODUCTION METHOD

(71) Applicant: TAIKO PHARMACEUTICAL CO., LTD., Osaka (JP)

(72) Inventors: Shigeo Asada, Osaka (JP); Koichi Nakahara, Osaka (JP); Kouichi Taura, Osaka (JP); Daisuke Kato, Osaka (JP)

(73) Assignee: Taiko Pharmaceutical Co., Ltd., Osaka (JP)

( * ) Notice: Subject to any disclaimer, the term of this patent is extended or adjusted under 35 U.S.C. 154(b) by 244 days.

(21) Appl. No.: 14/911,931

(22) PCT Filed: Sep. 1, 2014

(86) PCT No.: PCT/JP2014/072910
§ 371 (c)(1),
(2) Date: Feb. 12, 2016

(87) PCT Pub. No.: WO2015/033887
PCT Pub. Date: Mar. 12, 2015

(65) Prior Publication Data

US 2016/0201203 A1 Jul. 14, 2016

(30) Foreign Application Priority Data

Sep. 9, 2013 (JP) ..... 2013-186366

(51) Int. Cl.
*C25B 1/26* (2006.01)
*C25B 15/08* (2006.01)
*C25B 9/08* (2006.01)

(52) U.S. Cl.
CPC ..... *C25B 1/26* (2013.01); *C25B 9/08* (2013.01); *C25B 15/08* (2013.01)

(58) Field of Classification Search
USPC ..... 205/556
See application file for complete search history.

(56) References Cited

U.S. PATENT DOCUMENTS 2,163,793 A 6/1939 Logan
4,432,856 A 2/1984 Murakami et al.
(Continued)

FOREIGN PATENT DOCUMENTS

CN 102066618 A 5/2011
JP 56-158883 A 12/1981
(Continued)

OTHER PUBLICATIONS

International Preliminary Report on Patentability dated Mar. 24, 2016.
(Continued)

*Primary Examiner* — Harry D Wilkins, III
(74) *Attorney, Agent, or Firm* — Dilworth & Barrese, LLP

(57) ABSTRACT

A chlorine dioxide production device 1 includes a diaphragm electrolytic cell 2 having an anode chamber 3 and a cathode chamber 5 and configured to effect an electrolytic treatment on anolyte solution containing chlorite supplied to the anode chamber 3 for generating chlorine dioxide, a flow path section C communicating the anode chamber 3 to the cathode chamber 5, a discharge section D communicating the cathode camber 5 to the outside, an aerating means 14 for supplying aeration gas to the anode chamber with allowing adjustment of its supply amount, and a neutralizing means 12 for supplying a neutralizing agent to at least one of the cathode chamber 5 and the discharge section D.

7 Claims, 3 Drawing Sheets

(56) References Cited

U.S. PATENT DOCUMENTS

| | | | | |
|---|---|---|---|---|
| 5,158,658 | A | 10/1992 | Cawlfield | |
| 2006/0226023 | A1* | 10/2006 | Nanjundiah | C25B 1/26 205/556 |
| 2011/0100833 | A1 | 5/2011 | Asada et al. | |
| 2013/0043126 | A1 | 2/2013 | Asada et al. | |

FOREIGN PATENT DOCUMENTS

| | | | |
|---|---|---|---|
| JP | 2-205693 | A | 8/1990 |
| JP | 02-205693 | A | 8/1990 |
| WO | 2011115220 | | 9/2011 |

OTHER PUBLICATIONS

International Search Report dated Nov. 18, 2014.
European Search Report dated Mar. 14, 2017.
First Chinese Office Action dated May 18, 2017.

* cited by examiner

CHLORINE DIOXIDE PRODUCTION DEVICE AND CHLORINE DIOXIDE PRODUCTION METHOD

TECHNICAL FIELD

The present invention relates to a device and a method for producing chlorine dioxide by electrolyzing anolyte solution containing chlorite with using a diaphragm electrolytic cell having an anode chamber and a cathode chamber.

BACKGROUND ART

As a conventional chlorine dioxide production device and chlorine dioxide production method, ones discloses in e.g. Patent Document 1 identified below can be cited. In this document, there are described a device and a method for generating chlorine dioxide by implementing an electrolytic treatment while supplying an amount of anolyte solution containing chlorite and an amount of catholyte solution containing e.g. sodium hydroxide, sodium chloride etc. to an anode chamber and a cathode chamber respectively of a diaphragm electrolytic cell.

BACKGROUND ART DOCUMENT

Patent Document

Patent Document 1: Japanese Examined Patent Publication No. 59-6915

SUMMARY

Problem to be Solved by Invention

A chlorine dioxide production device having a diaphragm electrolytic cell has a higher chlorine dioxide production efficiency as compared with one-solution type chlorine dioxide production device not using a diaphragm. On the other hand, generated chlorine dioxide tends to be present at a high concentration inside the device, thus increasing the risk of explosion occurrence. Thus, there is a need to dilute chlorine dioxide as speedily as possible. The chlorine dioxide production device disclosed in Patent Document 1 above is configured such that chlorine dioxide is collected/diluted by transferring anolyte solution in which chlorine dioxide remains dissolved therein is transferred to an aeration tank via a pipe to be subjected to an aeration treatment. As such, there is the risk of explosion due to failure of complete dissolution of the chlorine dioxide in the anolyte solution in the course of transfer to the aeration tank. And, also, the configuration of the device was complicated.

Moreover, the above-described chlorine dioxide production device is arranged such that anolyte solution and catholyte solution are supplied respectively and independently to the anode chamber and the cathode chamber. Therefore, a supply system such as a storage tank and a solution feeding pump etc. for supplying the anolyte solution and the catholyte solution is required for each one of the anode chamber and cathode chamber. This leads to increased complexity of the device configuration, so that cost increase can occur in various respects such as designing, production, operation, maintenance/inspection, etc.

Moreover, with the above-described chlorine dioxide production device, it is necessary to effect a waste liquid treatment for the anolyte solution containing uncollected and residual chlorine dioxide and for the catholyte solution having a high pH value, separately of each other. Thus, for the significant trouble thereof, there is the possibility of the waste liquid treatments being not effected appropriately, so that there was a concern about environmental pollution.

The object of the present invention is to provide a chlorine dioxide production device and a chlorine dioxide production method that can produce chlorine dioxide by a more simple arrangement and process and that also can reduce the concentration of chlorine dioxide speedily and can further carry out respective waste liquid treatments of the anolyte solution and the catholyte solution easily.

Solution

According to a first characterizing feature of a chlorine dioxide production device relating to the present invention, the device comprises:

a diaphragm electrolytic cell including an anode chamber and a cathode chamber and configured to effect an electrolytic treatment on anolyte solution containing chlorite supplied to the anode chamber for generating chlorine dioxide;

a flow path section communicating the anode chamber to the cathode chamber;

a discharge section communicating the cathode camber to the outside;

an aerating means for supplying aeration gas to the anolyte solution in the anode chamber with allowing adjustment of its supply amount; and a neutralizing means for supplying a neutralizing agent to at least one of the cathode chamber and the discharge section;

wherein the anolyte solution is subjected to the electrolytic treatment in the anode chamber to generate chlorine dioxide, the generated chlorite dioxide is collected by supplying the aeration gas to the anolyte solution in the anode chamber by the aerating means, the anolyte solution after the electrolytic treatment and the aeration treatment in the anode chamber flows through the flow path section into the cathode chamber to be subjected to an electrolytic treatment as a catholyte solution therein and then subjected to a neutralization treatment in at least one of the cathode chamber and the discharge section.

[Function and Effect]

With the above-described feature, it is possible for the aeration means to supply aeration gas into the anode chamber for effecting an aeration treatment on the anolyte solution. With this, it becomes possible to avoid explosion through speedy reduction of the chlorine dioxide concentration with restricting dissolution of generated chlorine dioxide into the anolyte solution. Consequently, generated chlorine dioxide can be collected in a more efficient and safe manner. Further, since the aeration gas is supplied directly to the anode chamber, there is no need to provide an aeration tank or the like additionally, so that the device configuration can be simplified.

Further, with the above-described feature, it becomes possible to cause the anolyte solution after the electrolytic treatment and aeration treatment in the anode chamber to be transferred into the cathode chamber via the flow path section to be used directly as a catholyte solution. Conventionally, anolyte solution and catholyte solution would be supplied respectively to the anode chamber and the cathode chamber independently of each other. Therefore, a supply system such as a storage tank and a solution feeding pump etc. for supplying the anolyte solution and the catholyte solution would be required for each one of the anode chamber and cathode chamber. On the other hand, with the above-described feature, only such a supply system for the anode chamber is required, so that the device configuration can be simplified, thus realizing reduction of various costs.

Furthermore, with the above-described feature, the anolyte solution after the electrolytic treatment and aeration treatment in the anode chamber is transferred into the cathode chamber via the flow path section to be subjected to an electrolytic treatment therein. With this, even if a portion of generated chlorine dioxide fails to be collected in the anode chamber and remains within the anolyte solution inadvertently, this will be subjected to cathode reduction in the cathode chamber, thus being rendered into chlorite. Moreover, catholyte solution having a high pH value after the electrolytic treatment in the cathode chamber is subjected to a neutralization treatment by a neutralizing agent supplied from the neutralizing means in at least one of the cathode chamber and the discharge section.

That is, with the above-described feature, i.e. the feature of using anolyte solution after the electrolytic treatment and the aeration treatment in the anode chamber directly as a catholyte solution and effecting a neutralization treatment on the catholyte solution after the electrolytic treatment in the cathode chamber, the waste liquid treatment of the anolyte solution containing chlorine dioxide remaining therein and the catholyte solution having a high pH value can be effected at one time in the course of passage from the cathode chamber through the discharge section and discharge therefrom, rather than being effected individually. Consequently, the waste liquid treatment can be simplified.

According to a second characterizing feature, the diaphragm electrolytic cell, the flow path section and the discharge section are unified all together.

[Function and Effect]

With the above-described feature, since the diaphragm electrolytic cell, the flow path section and the discharge section are unified all together, the configuration of the chlorine dioxide generation device can be made compact.

According to a third characterizing feature, the flow path section includes a deaeration tank, and the aerating means supplies the aeration gas to the anode chamber and also to the deaeration tank.

[Function and Effect]

With the above-described feature, aeration treatment is effected not only in the anode chamber, but also in the deaeration tank. Therefore, of the generated chlorine dioxide, any portion thereof uncollected in the anode chamber can be collected in the deaeration tank, so that generated chlorine dioxide can be collected in an even more reliable manner.

According to a fourth characterizing feature, the discharge section includes a neutralization tank, and the neutralizing means supplies the neutralizing agent to the neutralization tank.

[Function and Effect]

With the above-described feature, with provision of the neutralization tank, the neutralization treatment can be effected in an even more efficient manner.

According to a characterizing feature of a chlorine dioxide production method relating to the present invention, the method using a diaphragm electrolytic cell including an anode chamber and a cathode chamber, the method comprises:

a supplying step of supplying anolyte solution containing chlorite to the anode chamber of the diaphragm electrolytic cell;

an anode electrolysis step of effecting an electrolytic treatment on the anolyte solution for generating chlorine dioxide;

an aeration step of supplying aeration gas to the anolyte solution in the anode chamber to collect the generated chlorine dioxide;

a cathode electrolysis step of effecting an electrolytic treatment on the anolyte solution after the electrolytic treatment and aeration treatment in the anode chamber as a catholyte solution in the cathode chamber;

a discharge step of discharging the catholyte solution after the electrolytic treatment in the cathode chamber; and a neutralization step of effecting a neutralization treatment on the catholyte solution in at least one of the cathode electrolysis step and the discharge step.

[Function and Effect]

With the above-described feature, by the aeration step, aeration gas can be supplied to the anode chamber for effecting aeration treatment on the anolyte solution. With this, it becomes possible to avoid explosion through speedy reduction of the chlorine dioxide concentration with restricting dissolution of generated chlorine dioxide into the anolyte solution. Consequently, generated chlorine dioxide can be collected in a more efficient and safe manner.

Further, with the above feature, since the anolyte solution after the electrolytic treatment in the anode chamber is used directly as a catholyte solution, there is no need for additional step of supplying a catholyte solution to the cathode chamber, so that the production method can be simplified and various costs can be reduced.

Moreover, with the above feature, since the anolyte solution after the electrolytic treatment and the aeration treatment in the anode chamber is subjected as a catholyte solution to an electrolytic treatment in the cathode chamber, even if a portion of generated chlorine dioxide fails to be collected to remain in the anolyte solution, this will be subjected to a cathode reduction in the cathode chamber, thus being rendered into a chlorite or the like. Furthermore, the catholyte solution having a high pH value after the electrolytic treatment in the cathode chamber is subjected to a neutralization treatment in at least one of the cathode electrolysis step and the discharge step.

That is, with the above-described feature, i.e. the feature of using anolyte solution after the electrolytic treatment and the aeration treatment in the anode chamber directly as a catholyte solution and effecting a neutralization treatment on the catholyte solution after the electrolytic treatment in the cathode chamber, the waste liquid treatment of the anolyte solution containing chlorine dioxide remaining therein and the catholyte solution having a high pH value can be effected at one time in the course of discharge from the cathode chamber, rather than being effected individually. Consequently, the waste liquid treatment can be simplified.

Embodiments

Next, one embodiment respectively of a chlorine dioxide production device and a chlorine dioxide production method according to the present invention will be explained.

[Embodiment]

[1] Chlorine Dioxide Production Device

Figure 1:
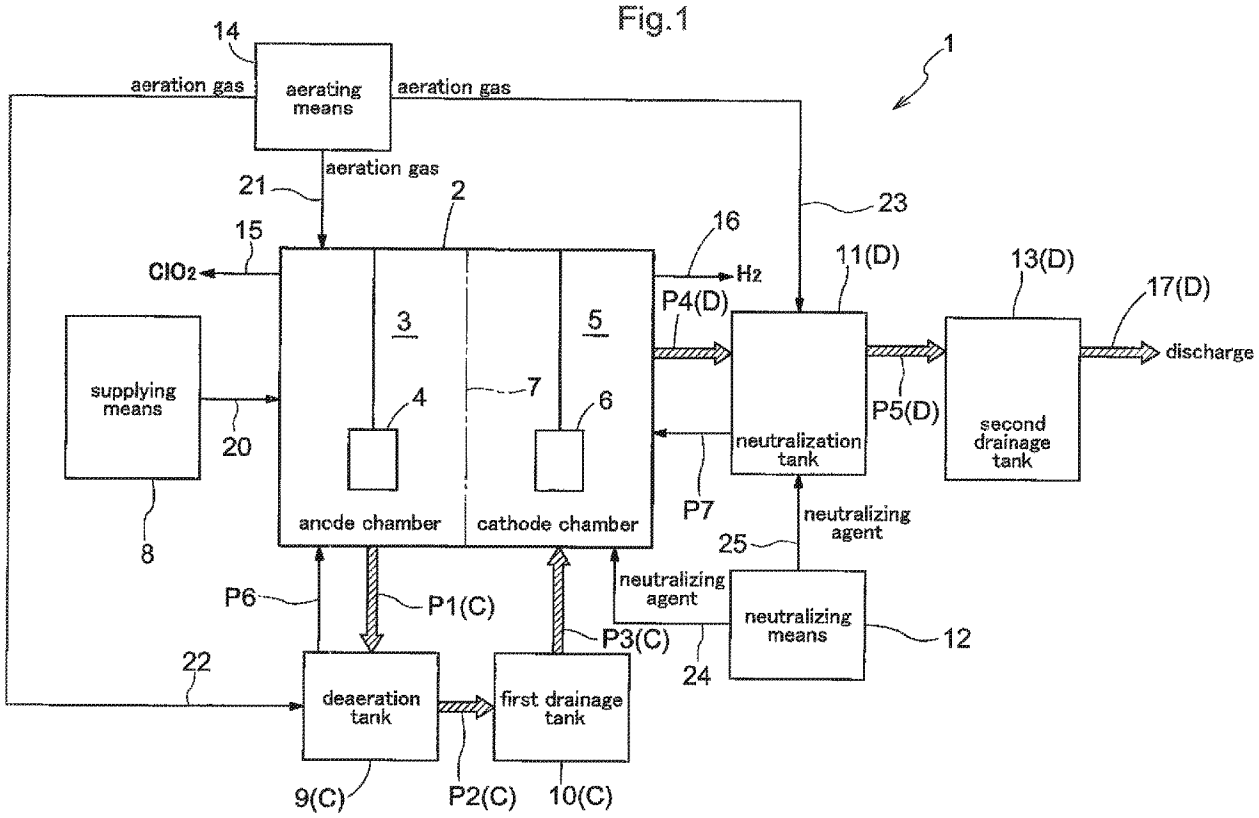
FIG. 1 is a schematic flow diagram of a chlorine dioxide production device of the present invention.

As shown in FIG. 1, a chlorine dioxide production device 1 according to this embodiment includes a diaphragm electrolytic cell 2 having an anode chamber 3 and a cathode chamber 5, a supplying means 8 for supplying anolyte solution containing chlorite to the diaphragm electrolytic cell 2, a deaeration tank 9, a first drainage tank 10, a neutralization tank 11 for effecting a neutralization treatment on the catholyte solution after an electrolytic treatment, a neutralizing means 12 for supplying a neutralizing agent, a second drainage tank 13, and an aerating means 14 for supplying aerating gas.

The anode chamber 3 and the deaeration tank 9 are communicated to each other via a first communication oath P1. The deaeration tank 9 and the first drainage tank 10 are communicated to each other via a second communication path P2. The first drainage tank 10 and the cathode chamber 5 are communicated to each other via a third communication path P3. The cathode chamber 5 and the neutralization tank 11 are communicated to each other via a fourth communication path P4. The neutralization tank 11 and the second drainage tank 13 are communicated to each other via a fifth communication path P5. Namely, in the chlorine dioxide production device 1, the anode chamber 3, the deaeration tank 9, the first drainage tank 10, the cathode chamber 5, the neutralization tank 11 and the second drainage tank 13 are communicated and connected in series via the first through fifth communication paths P1-P5.

Incidentally, in this embodiment, a flow path section C communicating the anode chamber 3 to the cathode chamber 5 is formed of the first communication path P1, the aeration tank 9, the second communication path P2, the first drainage tank 10 and the third communication path P3. However, the configuration of the flow path section C is not limited to this. Instead, the flow path section C can be comprised of only the first communication path P1, without including the deaeration tank 9, the first drainage tank 10, etc., so as to communicate the anode chamber 3 to the cathode chamber 5 directly.

Further, in this embodiment, a discharge section D communicating the cathode chamber 5 to the outside is formed of the fourth communication path P4, the neutralization tank 11, the fifth communication path P5, the second drainage tank 13 and a drainage pipe 17. However, the configuration of the discharge section D is not limited to this. Instead, the discharge section D can be comprised of only the drainage pipe 17, without including the neutralization tank 11, the second drainage tank 13, etc., so as to communicate the cathode chamber 5 to the outside directly. In the latter case, however, the neutralizing means 12 will be configured to supply the neutralizing agent to the cathode chamber 5.

(Diaphragm Electrolytic Cell)

As the diaphragm electrolytic cell 2, it is possible to employ a conventionally known diaphragm electrolytic cell in which the anode chamber 3 and the cathode chamber 5 are partitioned from each other by a cation exchange membrane 7.

In the anode chamber 3 and the cathode chamber 5 respectively, an anode 4 and a cathode 6 are provided as electrodes. As these electrodes, conventionally known electrodes can be employed. For instance, as some examples of cathode material, titanium, stainless steel, nickel, nickel chromium alloy, and other valve metals can be cited. Further, as some examples of anode material, noble metals such as platinum, gold, palladium, iridium, rhodium, and ruthenium, platinum-coated material having platinum electroplated on graphite, graphite felt, multi-walled graphite cloth, graphite woven fabric, carbon, or titanium, electrode comprised of oxide of valve metal such as titanium, tantalum, niobium, or zirconium, can be cited, and one coated with an electrode catalyst can be used preferably.

As for the cation exchange membrane 7 too, a conventionally known one can be employed. But, a fluorocarbon type cation exchange membrane 7 having superior selective permeability, durability is preferred.

(Neutralizing Means)

The neutralizing means 12 used in this embodiment is configured to supply a neutralizing agent to at least one of the cathode chamber 5 and the neutralization tank 11. However, the configuration of the neutralizing means 12 is not limited to this. Instead, the neutralizing means 12 can be configured such that the neutralizing treatment is effected in at least one of the cathode chamber 5 and the discharge section D. In case the neutralizing treatment is effected in the discharge section D, it is possible to configure such that the neutralizing agent is supplied not only to the neutralization tank 11, but also to any one of the fourth communication path P4, the fifth communication path P5, the second drainage tank 13 and the drainage pipe 17, which constitute the discharge section D.

As the neutralizing means 12, it is possible to employ a conventionally known one, e.g. one having a storage tank for storing the neutralizing agent, a liquid feeding pump, a liquid feeding pipe, etc. As examples of neutralizing agent that can be used, hydrochloric acid, sulfuric acid, citric acid, fumaric acid, formic acid, lactic acid, phosphoric acid, tartaric acid, butyric acid, various kinds of phosphate, etc. can be cited. And, these can be used singly or in any combination of two or more kinds.

(Supplying Means)

As the supplying means 8, one having a conventionally known configuration, such as one having a storage tank for storing anolyte solution containing chlorite, a liquid feeding pump, and a liquid feeding pipe, etc. can be used. As some examples of chlorite usable, alkali metal chlorite, alkali earth metal chlorite can be cited. As some examples of alkali metal chlorite, sodium chlorite, potassium chlorite, and lithium chlorite can be cited. As some examples of alkali earth metal chlorite, calcium chlorite, magnesium chlorite, barium chlorite can be cited. Among these, sodium chlorite and potassium chlorite are preferred in the respect of availability. And, sodium chlorite is most preferred.

These chlorites can be used singly or in combination of two or more kinds thereof. As to the concentration of chlorite in the anolyte solution, a concentration ranging from 1 wt % to 25 wt % is preferred, taking such factors into consideration as generation efficiency of chlorine dioxide, safety, stability, prevention of crystal deposition of chlorite, etc.

(Aerating Means)

As the aerating means 14, it is possible to employ one conventionally known having an aeration pump capable of adjustment of supply amount of aeration gas, a duct for introducing the aeration gas from the aeration pump to various tanks, etc.

The aerating means 14 employed in this embodiment is configured to supply the aeration gas to the anode chamber 3 of the diaphragm electrolytic cell 2, the deaeration tank 9 and the neutralization tank 11, respectively. And, as some examples of aeration gas usable, air or inactive gas such as nitrogen or argon can be cited.

[2] Chlorine Dioxide Production Method

Next, a method of producing chlorine dioxide with using the above-described chlorine dioxide production device 1 will be explained. By activating the supplying means 8, anolyte solution containing chlorite (aqueous solution of chlorite) is supplied continuously to the anode chamber 3 of the diaphragm electrolytic cell 2 (supplying step). Also, for only the initial stage, an amount of catholyte solution or two-fold diluted anolyte solution will be stored in advance in the cathode chamber 5 of the diaphragm electrolytic cell 2.

The anolyte solution supplied to the anode chamber 3 is subjected to an electrolytic treatment. More particularly, in the anode chamber 3, there are present chlorite ions ($ClO_2^-$) and positive ions (sodium ion in case sodium chlorite is employed as the chlorite). Therefore, when a direct current is applied from a DC power device (not shown) to the diaphragm electrolytic cell 2, the chlorite ions, electrons (e) are emitted from the anode as shown by the following formula (1), so that chlorine dioxide ($ClO_2$) is generated (anode electrolysis step).

$$ClO_2^- \rightarrow ClO_2 + e \qquad \text{Formula (1)}$$

On the other hand, positive ions permeate the cation exchange membrane 7 to enter the cathode chamber 5.

Chlorine dioxide generated according to the above Formula (1), due to its high solubility, will be dissolved in the anolyte solution, but as its liquid concentration is reduced by the aeration gas introduced by the aerating means 14 in accordance with the vapor-liquid equilibrium relationship, so that the chlorine dioxide is expelled from the liquid. This expelled chlorine dioxide is diluted by the supplied aeration gas to a lower concentration than a concentration capable of explosion avoidance (approximately 10% v/v) and will be collected as such by a collection pipe 15 (aeration step).

The anolyte solution after the electrolytic treatment in the anode chamber 3 flows through the first communication path P1 to enter the deaeration tank 9. In this deaeration tank 9 too, an aeration step is again effected by the aeration gas supplied by the aerating means 14, whereby any chlorine dioxide remaining in the anolyte solution will be expelled from the liquid. This expelled chlorine dioxide flows through the sixth communication path P6 communicating the anode chamber 3 and the deaeration tank 9 to enter the anode chamber 3 again and is collected from the collection pipe 15. In this deaeration tank 9 too, the expelled chlorine dioxide is diluted by the aeration gas to a lower concentration than the concentration capable of explosion avoidance (approximately 10% v/v).

Incidentally, in the instant embodiment, by allowing adjustment of the supply amount of the aeration gas to the anode chamber 3 and the deaeration tank 9, the concentration of chlorine dioxide is controlled, so that chlorine dioxide of a concentration desired by a user may be produced simultaneously with the dilution.

The anolyte solution after the aeration treatment in the deaeration tank 9 flows through the second communication path P2 to enter the first drainage tank 10. And, this anolyte solution introduced in the first drainage tank 10 now flows through the third communication path P3 to enter as a catholyte solution this time, the cathode chamber 5 of the diaphragm electrolytic cell 2.

In the cathode chamber 5, if a portion of chlorine dioxide remains in the anolyte solution supplied as catholyte solution, as being uncollected in the anode chamber 3 or the deaeration chamber 9, such remaining chlorine dioxide will be subjected to a cathode reduction by the cathode 6 of the cathode chamber 5, thus being rendered into chlorite.

Further, in the cathode chamber 5, a portion of water contained in the supplied anolyte solution (catholyte solution) is separated into hydrogen ions (H+) and hydroxide ions (OH−), so as shown by the following Formula (2), the hydrogen ions will obtain electrons at the cathode 6, whereby hydrogen gas ($H_2$) is generated (cathode electrolysis step).

$$2H^+ + 2e^- \rightarrow H_2 \qquad \text{Formula (2)}$$

On the other hand, the hydroxide ions residual therein will be rendered to alkali (e.g. sodium hydroxide in case the positive ions are sodium ions). Therefore, the catholyte solution after the electrolytic treatment in the cathode chamber 5 contains a large amount of alkali, thus having a high pH value. This catholyte solution having a high pH value is neutralized by the neutralizing agent supplied from the neutralizing means 12 (neutralization step).

The neutralizing means 12 used in this embodiment is configured to supply the neutralizing agent to at least one of the cathode chamber 5 and the neutralization tank 11. Therefore, the catholyte solution having a high pH value is neutralized in at least one of the cathode chamber 5 and the neutralization tank 11.

In particular, in case the catholyte solution is neutralized in the neutralization tank 11 used in this embodiment, when the catholyte solution having a high pH value after the electrolytic treatment in the cathode chamber 5 flows through the fourth communication path P4 to enter the neutralization tank 11, this, together with the neutralizing agent supplied from the neutralizing means 12, is agitated and mixed intensely with the aeration gas supplied by the aerating means 14, so a highly efficient neutralization treatment will be effected.

The aeration gas supplied to the neutralization tank 11 will then flow through the seventh communication path P7 communicating the cathode chamber 5 and the neutralization tank 11 to enter the cathode chamber 5. This introduced aeration gas will be discharged form the discharge pipe 16 together with hydrogen gas while diluting the hydrogen generated in the cathode chamber 5 to a lower concentration than the concentration capable of explosion avoidance (approximately 4% v/v).

The catholyte solution after the neutralization treatment in the neutralization tank 11 will then flow through the fifth communication path P5 to enter the second drainage tank 13. Then, the catholyte solution introduced to the second drainage tank 13 will be discharged from the exhaust liquid pipe 17 to the outside of the device.

[Other Embodiment]

In the foregoing embodiment, the diaphragm electrolytic cell uses a cation exchange membrane as a partition membrane for partitioning the cathode chamber from the anode chamber. The invention is not limited thereto. A neutral membrane can be used also.

EXAMPLE

Next, an example of a chlorine dioxide production kit K applied to the chlorine dioxide production device of the present invention will be explained with reference to the accompanying drawings. Incidentally, in this disclosure, "thickness direction", "height direction" and "width direction" mean directions along arrows X1, X2, X3 shown in FIG. 2, respectively.

Figure 2:
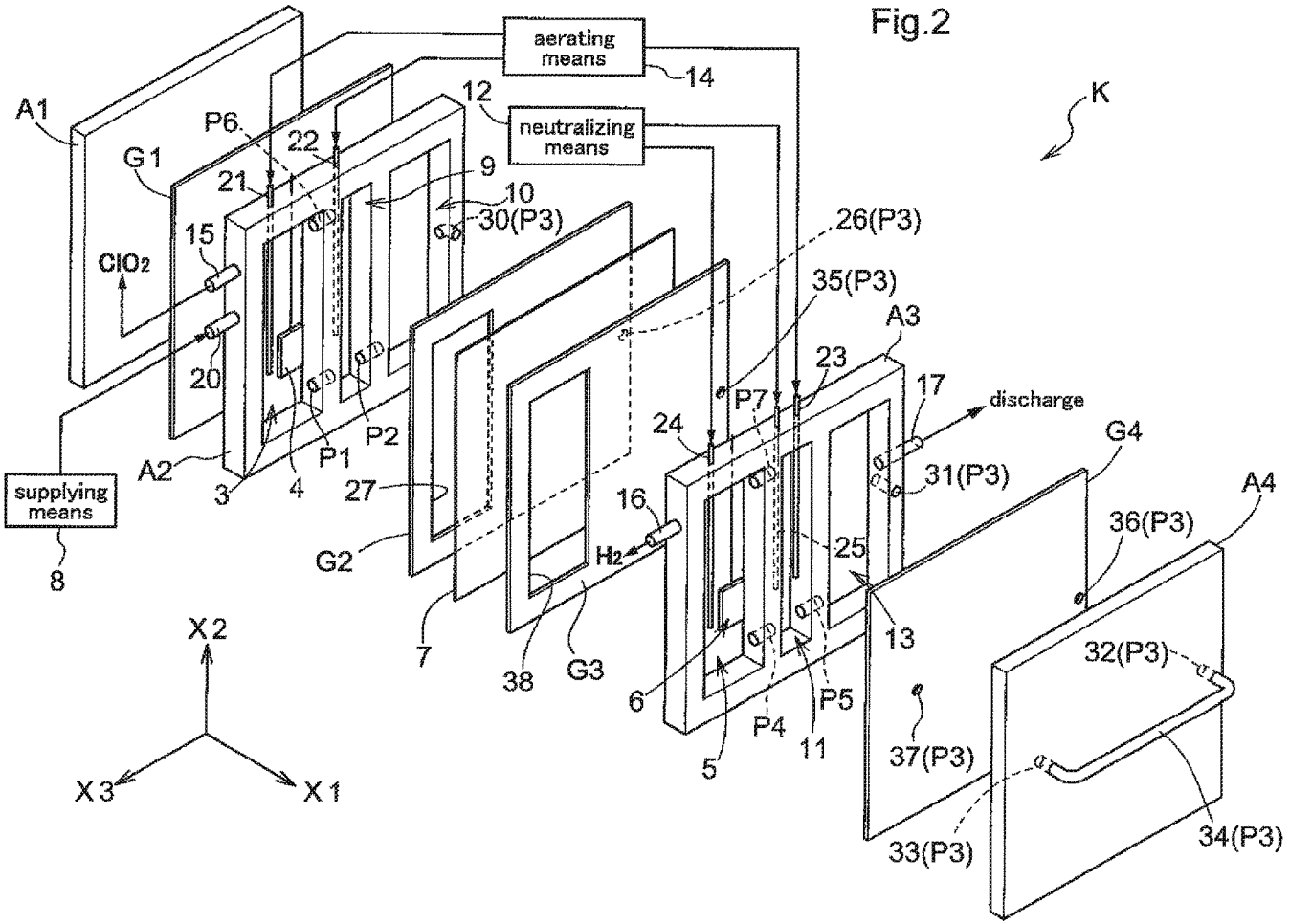
FIG. 2 is an exploded perspective view of the chlorine dioxide production device of the present invention.

As shown in FIG. 2, the chlorine dioxide generation kit K includes first through forth members A1-A4, first through fourth gasket members G1-G4, a cation exchange membrane 7, and an unillustrated outer frame member. All of the first through forth members A1-A4, the first through fourth gasket members G1-G4, and the cation exchange membrane 7 are rectangular members having a same width and a same height.

All of the first through forth members A1-A4 are rectangular plate members which are formed of a durable material such as polyvinyl chloride or the like. Incidentally, each one of the first member Al and the fourth member A4 is formed thinner than each one of the second member A2 and the third member A3.

Figure 3:
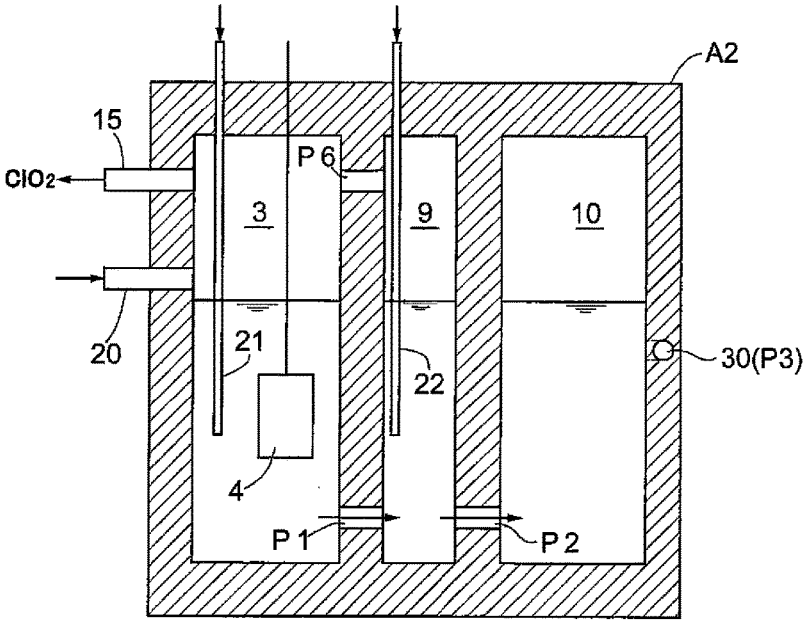
FIG. 3 is a vertical section view of a second plate member.

As shown in FIG. 2 and FIG. 3, the second member A2 is provided with three through rectangular spaces extending therethrough in the thickness direction. And, these three through spaces constitute the anode chamber 3, the deaeration tank 9 and the first drainage tank 10, respectively.

The anode 4 is disposed within the anode chamber 3 of the second member A2.

In the lateral wall of the second member A2 on the anode chamber 3 side, there are provided a collection pipe 15 for collecting chlorine dioxide of the anode chamber 3 and an anolyte solution introducing pipe 20 for introducing an amount of anolyte solution from the supplying means 8 (see FIG. 1) to the anode chamber 3. Incidentally, the anolyte solution introducing pipe 20 is disposed downwardly of the collection pipe 15.

A first gas introducing pipe 21 for introducing aeration gas from the aerating means 14 (see FIG. 1) into the anode chamber 3 extends through an upper wall of the second member A2, with its leading end being opened into a lower space of the anode chamber 3.

A second gas introducing pipe 22 for introducing aeration gas from the aerating means 14 into the deaeration tank 9 extends through the upper wall of the second member A2, with its leading end being opened into a lower space of the deaeration tank 9.

At an upper portion and a lower portion of a partition wall between the anode chamber 3 and the deaeration tank 9 respectively, the sixth communication path P6 and the first communication path P1 communicating between the anode chamber 3 and the deaeration tank 9 are provided. Further, at a lower portion of a partition wall between the deaeration tank 9 and the first drainage tank 10, the second communication path P2 communicating the deaeration tank 9 to the first drainage tank 10 is provided.

In a lateral wall of the second member A2 on the first drainage tank 10 side, there is provided an L-shaped communication path 30 which communicates from an inner wall face of the first drainage tank 10 to mating face with the second gasket member G2.

Figure 4:
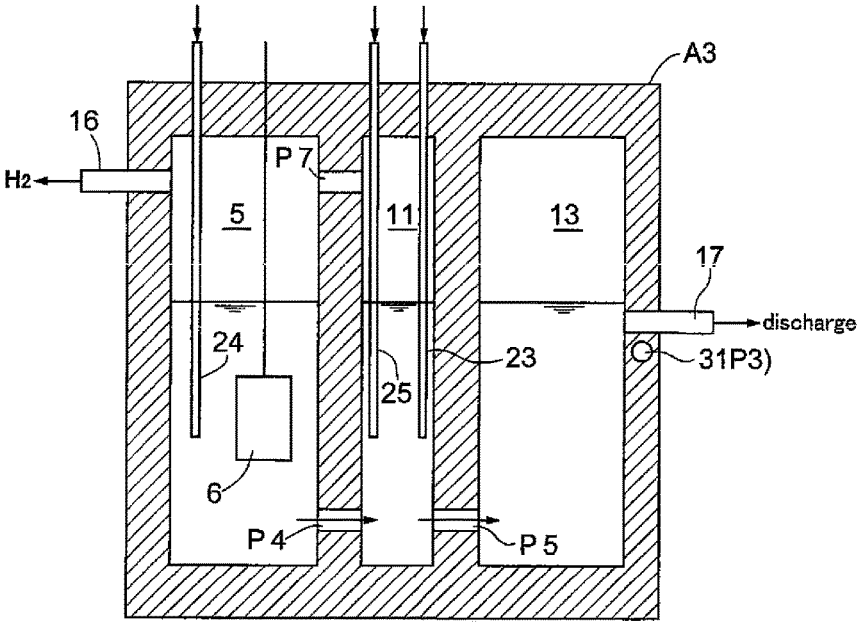
FIG. 4 is a vertical section view of a third plate member.

As shown in FIG. 2 and FIG. 4, the third member A3 is provided with three through rectangular spaces extending therethrough in the thickness direction. And, these three through spaces constitute the cathode chamber 5, the neutralization tank 11 and the second drainage tank 13, respectively.

The cathode 6 is disposed in the cathode chamber 5 of the third member A3.

In a lateral wall of the third member A3 on the cathode chamber 5 side, there is provided the discharge pipe 16 for discharging hydrogen gas generated in the cathode chamber 5.

A first neutralizing agent introducing pipe 24 for introducing neutralizing agent from the neutralizing means 12 to the cathode chamber 5 extends through an upper wall of the third member A3, with its leading end being opened into the lower space of the cathode chamber 5.

A third gas introducing pipe 23 for introducing the aeration gas from the aerating means 14 to the neutralization tank 11 and a second neutralizing agent introducing pipe 25 for introducing the neutralizing agent from the neutralizing means 12 (see FIG. 1) to the neutralization tank 11 extend through an upper wall of the third member A3, with the respective leading ends thereof being opened into the lower space of the neutralization tank 11.

At an upper portion and a lower portion of a partition wall between the cathode chamber 5 and the neutralization tank 11 respectively, the seventh communication path P7 and the fourth communication path P4 communicating between the cathode chamber 5 and the neutralization tank 11 are provided. Further, at a lower portion of a partition wall between the neutralization tank 11 and the second drainage tank 13, the fifth communication path P5 communicating the neutralization tank 11 to the second drainage tank 13 is provided.

In a lateral wall of the third member A3 on the second drainage tank 13 side, there are provided the drainage pipe 17 for discharging the catholyte solution of the second drainage tank 13 to the outside of the device and a communication path 31 extending therethrough in the thickness direction. Incidentally, the communication path 31 is disposed downwardly of the drainage pipe 17.

As shown in FIG. 2, the fourth member A4 is provided, at the respective opposed ends thereof in the width direction, with through holes 32, 33 extending therethrough in the thickness direction, and these through holes 32, 33 are communicated and connected via a hook-shaped pipe 34.

The first through fourth gasket members G1-G4 all comprise rectangular plate members formed of a chemical resistant material such as ethylene-propylene-diene rubber (EPDM), etc. With these first through fourth gasket members G1-G4, the chlorine dioxide production kit K is provided with high water-tightness, thus preventing liquid leak from the chlorine dioxide production kit K.

As shown in FIG. 2, the second gasket member G2 is provided with a through hole 26 which extends therethrough in the thickness direction at one width-wise end portion and also a rectangular through space 27 which extends therethrough in the thickness direction at the other end thereof. Further, the third gasket member G3, like the second gasket member G2, is provided with a through hole 35 which extends therethrough in the thickness direction at one width-wise end portion and also a rectangular through space 38 which extends therethrough in the thickness direction at the other end thereof. The width and the height of the through hole 27 of the second gasket member G2 are set to be equal to the width and the height of the anode chamber 3 of the second member A2 respectively or can also be set smaller than the width and the height of the anode chamber 3 of the second member A2 respectively. Further, as for the width and the height of the through space 38 of the third gasket member G3 too, these can be set equal to the width and the height of the cathode chamber 5 of the third member A3 respectively or can also be set smaller than the width and the height of the cathode chamber 5 of the third member A3 respectively.

The fourth gasket member G4 is provided, at the respective opposed width-wise ends thereof, with through holes 36, 37 extending therethrough in the thickness direction. Further, the cation exchange membrane 7 is provided, at its one width-wise end thereof, with an unillustrated through hole extending therethrough in the thickness direction.

When the chlorine dioxide production kit K is to be assembled, the first through fourth members A1-A4, the first through fourth gasket members G1-G4 and the cation exchange membrane 7 will be arranged as shown in FIG. 2. More particularly, the first gasket member G1 will be placed between the first member A1 and the second member A2. And, between the second member A2 and the third member A3, the second gasket member G2, the cation exchange membrane 7 and the third gasket member G3 will be placed in this mentioned order, and between the third member A3 and the fourth member A4, the fourth gasket member G4 will be placed.

In the course of the above, the second gasket member G2 will be placed in such a manner that its through space 27 may face the anode chamber 3 of the second member A2. And, the third gasket member G3 will be placed in a such a manner that its through space 38 may face the cathode chamber 5 of the third member A3. Further, the fourth gasket member G4 will be placed in such a manner that its one through hole 36 may face the communication path 31 of the third member G3 and its other through hole 37 may face the cathode chamber 5 of the third member A3. Also, the fourth member A4 will be placed in such a manner that its two through holes 32, 33 may respectively face the two through holes 36, 37 of the fourth gasket member G4.

Then, the first through fourth members A1-A4, the first through fourth gasket members G1-G4 and the cation exchange membrane 7 arranged as shown in FIG. 2, with keeping the respective ends thereof in alignment, will be fitted into the unillustrated outer frame member in gapless contact with each other, whereby the chlorine dioxide production kit K having a rectangular or cubic shape will be completed.

Inside the chlorine dioxide production kit K, communication is established between/among the communication path 30 of the second member A2, the through hole 26 of the second gasket member G2, the through hole (not shown) of the cation exchange membrane 7, the through hole 35 of the third gasket member G3, the communication path 31 of the third member A3, the one through hole 36 of the fourth gasket member G4, the one through hole 32 of the fourth member A4, the pipe 34, the other through hole 33 of the fourth member A4 and the other through hole 37 of the fourth gasket member G4. With this, the third communication path P3 communicating from the first drainage tank 10 of the second member A2 to the cathode chamber 5 of the third member A3 is formed.

Further, since the anode chamber 3 of the second member A2 is communicated to the through space 27 of the second gasket member G2 and the cathode chamber 5 of the third member A3 is communicated to the through space 38 of the third gasket member G3, the anode chamber 3 of the second member A2 will be disposed in opposition to the cathode chamber 5 of the third member A3 via the cation exchange membrane 7 therebetween, thus forming the diaphragm electrolytic cell 2.

That is, in the above-described chlorine dioxide production kit K, the diaphragm electrolytic cell 2, the flow path section C and the discharge section D are unified all together. Therefore, with using this chlorine dioxide production kit K, the configuration of the chlorine dioxide production device can be formed compact.

Next, chlorine dioxide was produced with using the chlorine dioxide production kit K having the above-described configuration.

A chlorine dioxide production kit K having 73 mm width, 148 mm height and 45 mm thickness including an anode 4 and a cathode 5 respectively having 18 mm width, 46 mm height and 1 mm thickness was manufactured. And, to the first and second gas introducing pipes 21, 22 of this chlorine dioxide production kit K, the aerating means 14 was connected, and to the anolyte solution introducing pipe 20 of the chlorine dioxide production kit K, the supplying means 8 was connected and further to the second neutralizing agent introducing pipe 25 of the chlorine dioxide production kit K, the neutralizing means 12 was connected, whereby the chlorine dioxide production device 1 was completed.

800 mL of 25 wt % sodium chlorite and 50 g of potassium chloride were dissolved in water to prepare 1L of anolyte solution. Then, this anolyte solution was fed at 14 mL/h by the liquid feeding pump of the supplying means 8.

Further, 200 g of potassium dihydrogen phosphate and 100 g of dibasic potassium phosphate were dissolved in water to prepare 1 L of neutralizing agent. Then, this neutralizing agent was fed at 14 mL/h by a liquid feeding pump of the neutralizing means 12.

A current of 800 mA was supplied to the anode 4 and the cathode 6 and also air was supplied by an aeration pump of the aerating means 14 to the anode chamber 3 and the deaeration tank 9. And, chlorine dioxide discharged from the collection pipe 15 was absorbed in potassium iodide solution for a predetermined period and released iodine was titrated with predetermined sodium thiosulfate solution. As a result, it was confirmed that chlorine dioxide was generated by 1.2 g/h. Further, in the drainage discharged from the drainage pipe 17, almost no chlorine dioxide was contained and pH was 7.8, so safe disposal thereof was possible.

INDUSTRIAL APPLICABILITY

The chlorine dioxide production device and the chlorine dioxide production method according to the present invention can be suitably used in industrial fields relating to environmental sterilization or deodorization by chlorine dioxide.

DESCRIPTION OF REFERENCE MARKS/NUMERALS

1 chlorine dioxide production device
2 diaphragm electrolytic cell
3 anode chamber
4 anode
5 cathode chamber
6 cathode
7 cation exchange membrane
8 supplying means
9 deaeration tank
10 first drainage tank
11 neutralization tank
12 neutralizing means
13 second drainage tank
14 aerating means
15 collection pipe
16 discharge pipe
17 drainage pipe
P1-P7 first through seventh communication paths
C flow path section
D discharge section

The invention claimed is:

1. A chlorine dioxide production device comprising:

a diaphragm electrolytic cell including an anode chamber and a cathode chamber and configured to effect an electrolytic treatment on anolyte solution containing chlorite supplied to the anode chamber for generating chlorine dioxide;

a flow path section communicating the anode chamber to the cathode chamber;

a discharge section communicating the cathode chamber to the outside;

an aerating means for supplying aeration gas to the anolyte solution in the anode chamber with allowing adjustment of its supply amount; and a neutralizing means for supplying a neutralizing agent to at least one of the cathode chamber and the discharge section;

wherein the anolyte solution is subjected to the electrolytic treatment in the anode chamber to generate chlorine dioxide, the generated chlorine dioxide is collected by supplying the aeration gas to the anolyte solution in the anode chamber by the aerating means, the anolyte solution after the electrolytic treatment and the aeration treatment in the anode chamber flows through the flow path section into the cathode chamber to be subjected to an electrolytic treatment as a catholyte solution therein and then subjected to a neutralization treatment in at least one of the cathode chamber and the discharge section, the flow path section includes a deaeration tank, the discharge section includes a neutralization tank, and the neutralizing means supplies the neutralizing agent to the neutralization tank, and the aerating means supplies the aeration gas to each of the anode chamber of the diaphragm electrolytic cell, the deaeration tank and the neutralization tank.

2. The chlorine dioxide production device according to claim 1, wherein the diaphragm electrolytic cell, the flow path section and the discharge section are unified all together.

3. The chlorine dioxide production device according to claim 1, wherein said anode chamber (3), said cathode chamber (5), a membrane (7) separating said anode and cathode chambers (3, 5) and said deaeration tank (9) are all arranged within a single frame.

4. The chlorine dioxide production device according to claim 3, wherein said anode chamber (3) and said deaeration tank (9) are arranged parallel to one another along a plane of the membrane (7), and said anode and cathode chambers (3, 5) are arranged parallel to one another along an axis perpendicular to the plane of the membrane (7).

5. The chlorine dioxide production device according to claim 3, comprising four separate members (A1-A4) together forming said frame when assembled, and four separate gasket members (G1G4) interposed between said respective members (A1-A4) when assembled, said first and four separate members (A1, A4) forming opposite ends of said frame, said first gasket (G1) interposed between said first and second separate members (A1, A2), said second separate member (A2) comprising three separated openings respectively forming said anode chamber (3), said deaeration tank (9) and a first drainage tank (10), said second gasket (G2) interposed between said second separate member (A2) and said membrane (7) and comprising an opening (27) aligned with said anode chamber (3), said third separate member (A3) comprising three separated openings respectively forming said cathode chamber (5), said neutralization tank (11) and a second drainage tank (13), said third gasket (G3) interposed between said membrane (7) and said third separate member (A3) and comprising an opening (38) aligned with said cathode chamber (5), and said fourth gasket (G4) interposed between said third and fourth separate members (A3, A4).

6. The chlorine dioxide production device according to claim 5, additionally comprising a first pipe (21) extending through said second separate member (A2) and into said anode chamber (3) and coupled to said aerating means (14), a second pipe (22) extending through said second separate member (A2) and into said deaeration tank (9) and coupled to said aerating means (14), a pair of pipes (15, 20) extending through said second separate member (A2) and into said anode chamber (3) and arranged for respectively supplying anolyte solution to and removing chlorine dioxide from said anode chamber (3), two separate paths (P1, P2) extending through said second separate member (A2) and respectively communicating said anode chamber (3), said deaeration tank (9) and said first drainage tank (10) with one another, a third path (P6) extending through said second separate member (A2) and also communicating said anode chamber (3) with said deaeration tank (9) to remove chlorine dioxide from said anode chamber (3), a communication path (30) extending through said second separate member (A2) into said first drainage tank (10) and towards said second gasket (G2), a third pipe (24) extending through said third separate member (A3) and into said cathode chamber (5) and coupled to said neutralizing means (12), a fourth pipe (23) extending through said third separate member (A3) into said neutralizing tank (11) and coupled to said aerating means (14), a fifth pipe (25) extending through said third separate member (A3) into said neutralizing tank (11) and coupled to said neutralizing means (12), two separate paths (P4, P5) extending through said third separate member (A3) and respectively communicating said cathode chamber (5), said neutralization tank (11) and said second drainage tank (13), a third path (P7) extending through said third separate member (A3) and also communicating said cathode chamber (3) with said neutralization tank (11), a second pair of pipes (16, 17) extending through said third separate member (A3) and respectively communicating with said cathode chamber (5) to discharge hydrogen gas and said second drainage tank (13) for discharging catholyte solution, a separate pipe (31) extending through said third separate member (A3) towards said fourth gasket (G4) which comprises a pair of through holes (36, 37), said second and third gaskets (G2, G3) each comprising a respective through hole (26, 35), said fourth separate member (A4) comprising a pair of through holes (32, 33), and a pipe (34) being arranged on an outer side of said fourth separate member (A4) and communicating with said pair of through holes (32, 33) in said fourth separate member (A4), said pair of through holes (36, 37) in said fourth gasket (G4), said separate pipe (31) extending through said third separate member (A3), said respective through holes (26, 35) in said second and third gaskets (G2, G3), and said communication path (30) extending through said second separate member (A2) and communicating said first drainage tank (10) with a surface of said second gasket (G2), such that a channel (P3) is formed communicating said first drainage tank (10) with said cathode chamber (5).

7. A chlorine dioxide production method using a diaphragm electrolytic cell including an anode chamber and a cathode chamber, the method comprising:

a supplying step of supplying anolyte solution containing chlorite to the anode chamber of the diaphragm electrolytic cell;

an anode electrolysis step of effecting an electrolytic treatment on the anolyte solution for generating chlorine dioxide;

a first aeration step of supplying aeration gas to the anolyte solution in the anode chamber to collect the generated chlorine dioxide;

a second aeration step of supplying aeration gas to th anolyte solution after the electrolytic treatment and aeration treatment in the anode chamber to collect the generated chlorine dioxide, and a cathode electrolysis step of effecting an electrolytic treatment on the anolyte solution after the electrolytic treatment and aeration treatment in the anode chamber as a catholyte solution in the cathode chamber;

a discharge step of discharging the catholyte solution after the electrolytic treatment in the cathode chamber;

a neutralization step of effecting a neutralization treatment on the catholyte solution in at least one of the cathode electrolysis step and the discharge step; and a third aeration step of supplying aeration gas to the catholyte solution when the neutralization treatment is effected on the catholyte solution in the discharge step.

* * * * *